US006520137B2

(12) United States Patent
Ooizumi et al.

(10) Patent No.: US 6,520,137 B2
(45) Date of Patent: Feb. 18, 2003

(54) STARTING MOTOR

(75) Inventors: Takehisa Ooizumi, Hitachinaka (JP); Yoshinori Fukasaku, Tokyo (JP); Toshihiko Iwabuchi, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/824,571

(22) Filed: Apr. 3, 2001

(65) Prior Publication Data

US 2001/0054407 A1 Dec. 27, 2001

Related U.S. Application Data

(63) Continuation-in-part of application No. 09/787,719, filed as application No. PCT/JP99/05352 on Sep. 29, 1999.

(30) Foreign Application Priority Data

Sep. 29, 1998 (JP) ..... 10-274616

(51) Int. Cl.[7] ..... F02N 11/08

(52) U.S. Cl. ..... 123/179.3; 290/38 R; 318/473; 361/25

(58) Field of Search ..... 123/179.3; 290/38 R, 290/38 C, 48; 310/68 C, 68 R; 318/473; 337/401, 404, 405; 335/142; 361/25

(56) References Cited

U.S. PATENT DOCUMENTS 4,198,617 A * 4/1980 Hara ..... 337/403
4,674,344 A * 6/1987 Kazino et al. ..... 290/38 R
4,789,800 A * 12/1988 Zimmermann ..... 310/68 C
5,642,696 A * 7/1997 Matsui ..... 123/179.1
6,028,381 A * 2/2000 Yumiyama et al. ..... 290/38 C

FOREIGN PATENT DOCUMENTS

JP 174760 * 11/1982
JP 09273464 A1 * 10/1997

* cited by examiner

*Primary Examiner*—Willis R. Wolfe
*Assistant Examiner*—Arnold Castro
(74) *Attorney, Agent, or Firm*—Crowell & Moring LLP

(57) ABSTRACT

A circuit disconnecting member that blows on receiving radiant heat generated by heat generation of a motor circuit is connected to a motor circuit, the blowing temperature being a temperature lower than a thermal breakdown temperature of a combustible substance around the motor circuit, whereby the motor circuit is shut off, when the peripheral part of the motor circuit generates heat, to stop heat generation before an insulation cover or a contact case is subjected to thermal connection breakage. An engine starting device is prevented from being subjected to a thermal breakdown by a small-size, simple construction and an inexpensive technique without impairing the mounting layout properties of the starting motor and the performance within the rated use.

9 Claims, 10 Drawing Sheets

STARTING MOTOR

CROSS-REFERENCE TO RELATED APPLICATIONS

This application is a continuation-in-part of U.S. application Ser. No. 09/787,719 filed on Mar. 22, 2001 which is the national stage of PCT/JP99/05352 filed Sep. 29, 1999.

TECHNICAL FIELD

The present invention relates to a starting motor, and particularly to a technique suitable for preventing a starting motor from resulting in a thermal breakdown.

BACKGROUND ART

Generally, when a starting motor receives continuous energization for starting engine or intermittent energization for a short time of cycle, self heat generation of an energization part increases, so that a part of which self heat generation is greater than radiation accumulates heat and the heat accumulating part itself or a part which receives radiant heat of the heat accumulating part assumes an abnormally high temperature, resulting in a thermal breakdown of a combustible substance of the part mentioned above.

As the procedure to prevent such a phenomenon as described, there is a prior art which have a construction in which a "fuse" is installed in a driving circuit of a starting motor. By "fuse" what is meant herein is that "An element is mounted in a circuit and blows quickly when an over load or an over current occurs.", and its fusing characteristic is generally set by "over current value×time". All the prior arts are constituted on the basis of the conception of the "fuses" as described above. A first prior art "Japanese Utility Model Laid-Open No. 57-174760 has a construction in which a "fuse" is provided in a motor main circuit of a starting motor, and a second prior art "Japanese Patent Laid-Open No. 9-273464 has a construction in which a part of a conductor constituting a motor circuit of a starting motor has locally an increased current density, which is used in place of the "fuse".

However, in the starting motor, a current flowing into the motor is always varied due to the engine load torque (for example, when no load is present, approximately 100 A, and when the engine is locked, approximately 1500 A, etc.), and further, in all current areas, there is the possibility that the thermal breakdown occurs with some time, thus making very difficult to satisfy the fusing time characteristic in all the current areas by means of one fuse. (For example, in a "fuse" whose fusing time characteristic is set by I (ampere)×T (time), there occurs a problem that the fuse does not blow when a motor current is not more than I.)

DISCLOSURE OF THE INVENTION

It is an object of the present invention to provide a starting motor capable of preventing the starting motor from resulting in a thermal breakdown by a small-size and simple construction and an inexpensive technique without impairing the mounting layout properties of the stating motor and the performance within the rated use.

To achieve the above-described object, there is provided a starting motor comprising a motor which is rotated by energization from a battery; a pinion to which the rotation of a motor is transmitted; a shift lever for moving the pinion to a ring gear of the engine; and an electromagnetic switch provided with a coil for inducing an electromagnetic force, an axially slidable plunger, and a contact for opening and closing energization to the motor; the starting motor comprising a circuit disconnecting part that blows on receiving radiant heat generated by heat generation of the motor circuit, the circuit disconnecting member being connected to the motor circuit and blowing at a temperature lower than a thermal breakdown temperature of a combustible substance around the motor circuit.

Preferably, there is provided the starting motor wherein a part of the motor circuit is used as the circuit disconnecting part.

More preferably, there is provided the starting motor wherein a material for a part for connecting a terminal of the contact for opening and closing energization to the motor to the motor circuit is used for the circuit disconnecting member.

More preferably, there is provided the starting motor wherein the circuit disconnecting member is installed in a battery cable and at a position which receives radiant heat generated by heat generation of the motor circuit.

More preferably, there is provided the starting motor wherein the circuit disconnecting member is installed in a key switch circuit and at a position which receives radiant heat generated by heat generation of the motor circuit.

BEST MODE FOR CARRYING OUT THE INVENTION

One embodiment of the present invention will be described hereinafter with reference to FIGS. 1 to 12.

Figure 10:
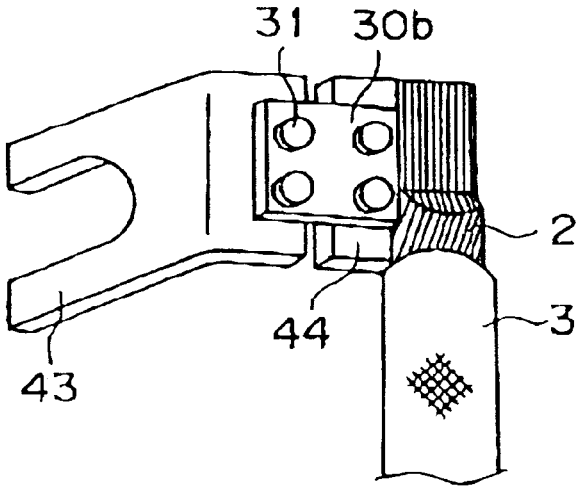
FIG. 10 is a construction view of one embodiment of the present invention.
Figure 11:
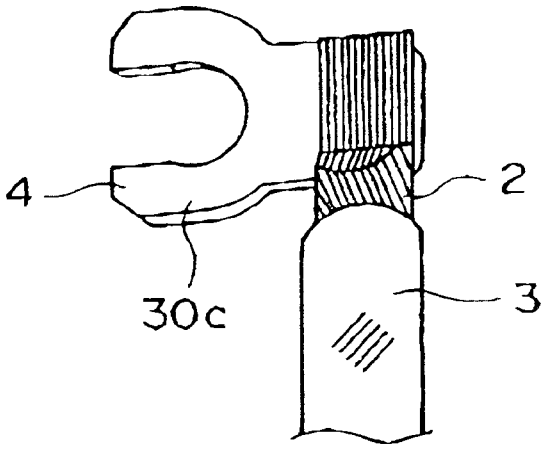
FIG. 11 is a construction view of one embodiment of the present invention.
Figure 12:
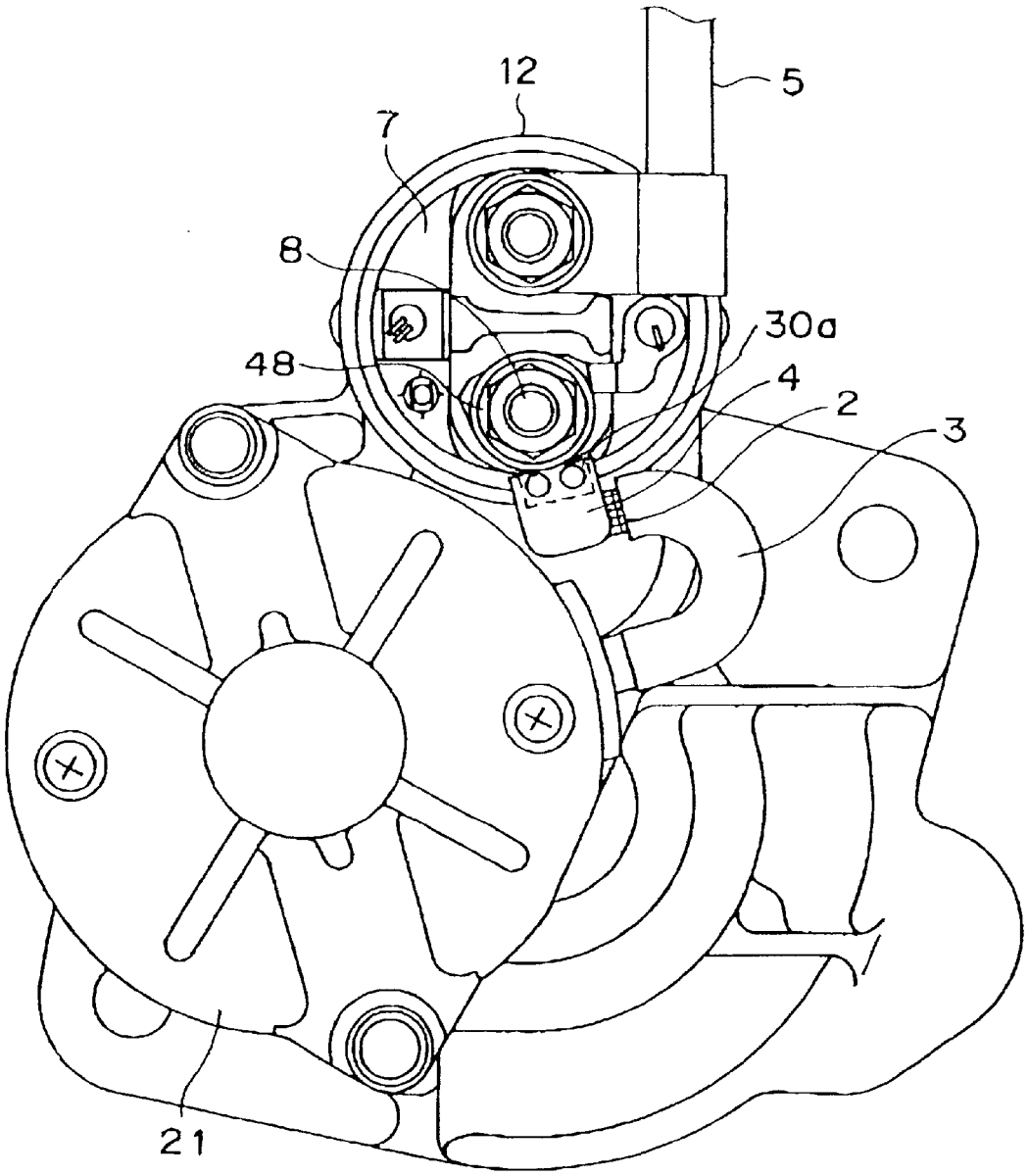
FIG. 12 is an external view of an engine starting device according to one embodiment of the present invention.

An external appearance as viewed on the rear cover side of the starting motor according to the present invention, and the whole sectional construction are shown in FIGS. 1 to 5 and 12, and FIG. 6, respectively. Further, an internal construction of one embodiment in FIGS. 1 and 2, details of one embodiment in FIG. 12 are shown in FIGS. 7 and 8, and FIGS. 9 to 11, respectively.

Referring to FIGS. 1 to 6 and FIG. 12, a starting motor 50 comprises an electromagnetic switch 12 having a coil 11 for inducing an electromagnetic force, a plunger 14 supported slidably in an axial direction, a movable contact 10 supported slidably in an axial direction, a terminal 9 to a battery in contact with the movable contact 10 for carrying out energization from the battery to a motor 21, and a terminal 8 to the motor.

Further, the starting motor 50 comprises a motor 21 rotated by energization from the battery, a pinion shaft 23 capable of sliding before and behind with respect to a gear case, a pinion 24 mounted on the extreme end of the pinion shaft 23, an over-running clutch 22 spline-connected to the pinion shaft 23 to transmit rotation of the motor 21 to the pinion shaft 23, and a shift lever 20 for moving the pinion shaft 23 toward an engine ring gear (not shown).

A connecting rod 17 provided with a square hole 15 is disposed at the extreme end of the plunger 14, and a head of the shift lever 20 is passed through and engaged with the square hole 15. The movable contact 10 is arranged axially opposite to the B terminal (battery connected) 9 and the M terminal (motor circuit connecting terminal) 8, which are encased in a contact casing 7 formed of resin.

A torsion spring 16 is provided, in a state that it is compressed from a free length and applied with pressure in advance, between a case end 13 of the electromagnetic switch 12 and a cut hole 19 of the shift lever 20, whereby the plunger 14 is pressed through the shift lever 20, the extreme end of the connecting rod 17 is held in contact with an end face of the gear case 18, and at the same time, a central portion of the shift lever 20 is also pressed and held in contact with the wall of the central portion of the gear case 18.

A section between the motor 21 and the M terminal 8 of the electromagnetic switch 12 is connected by a M lead wire (motor lead wire) 2 disposed on the side of the motor 21, and the outer circumference of the M lead wire 2 is covered with an insulating cover 3.

Figure 1:
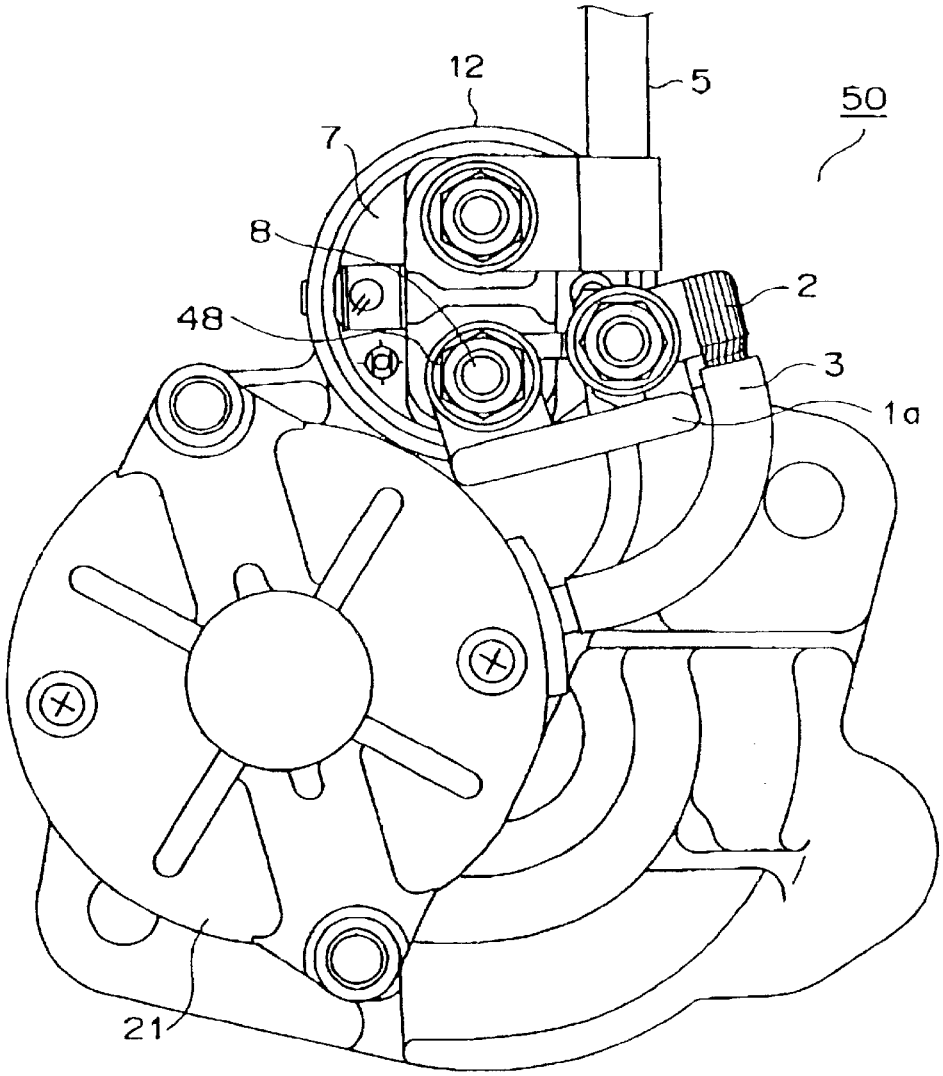
FIG. 1 is an external view of an engine starting device according to one embodiment of the present invention.
Figure 2:
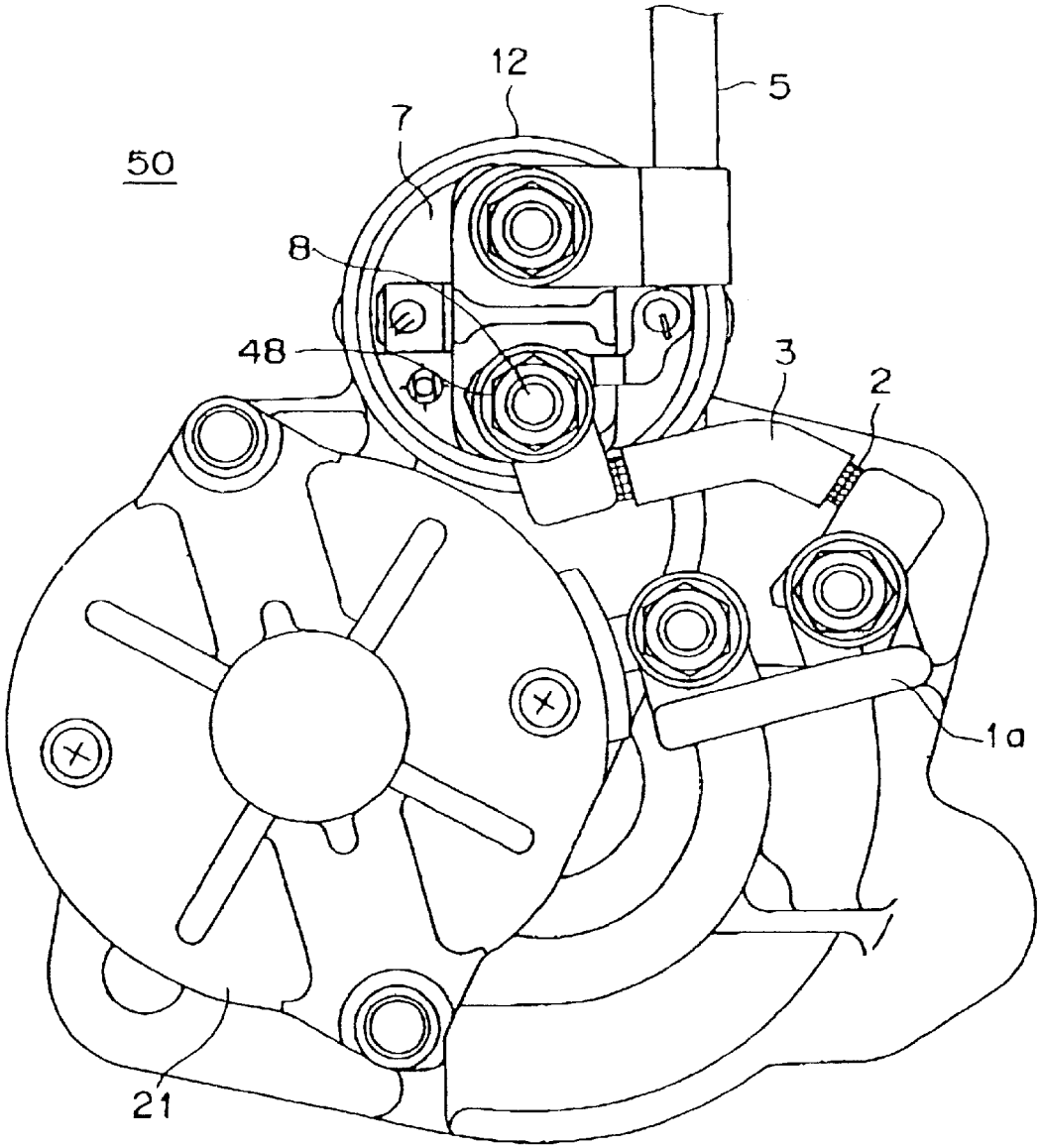
FIG. 2 is an external view of an engine starting device according to one embodiment of the present invention.
Figure 7:
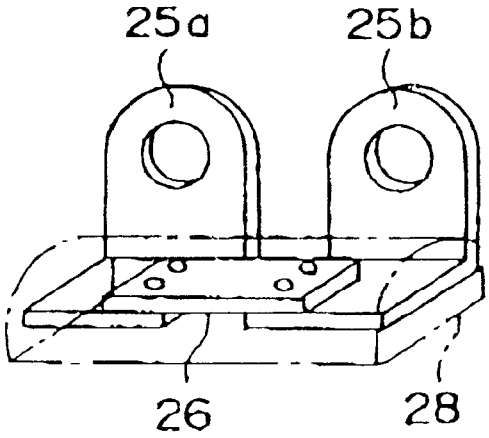
FIG. 7 is a construction view of one embodiment of the present invention.
Figure 8:
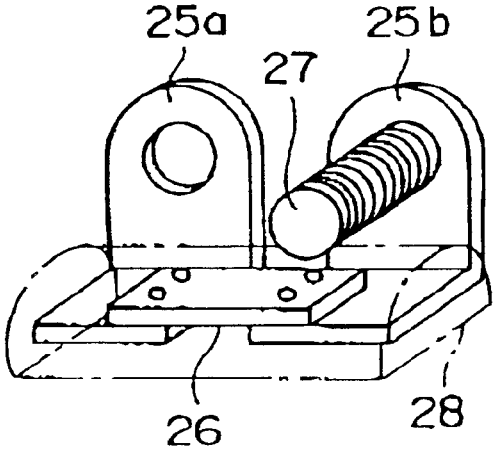
FIG. 8 is a construction view of one embodiment of the present invention.

In FIGS. 1 and 2, connected to one end of the M lead wire 2 is a circuit disconnector 1*a* that blows on receiving radiant heat generated by heat generation of a circuit of the motor 21 and blows at a temperature lower than a thermal breakdown temperature of combustible substances around the circuit of the motor 21. One embodiment of the construction of the circuit disconnector 1*a* is shown in FIGS. 7 and 8. A circuit disconnecting member of the circuit disconnector 1*a* comprises a plate member 26 formed of material of either copper alloy, soldering material or aluminum. L-shaped terminals 25*a* and 25*b* are connected to both bends of the plate member 26. The shape of the terminals 25*a* and 25*b* may be a stud bolt 27 as shown in FIG. 8. The plate member 26 and the outer circumference of the terminals 25*a* and 25*b* are covered with a heat resistant resin case 28 to protect peripheral apparatuses.

Figure 3:
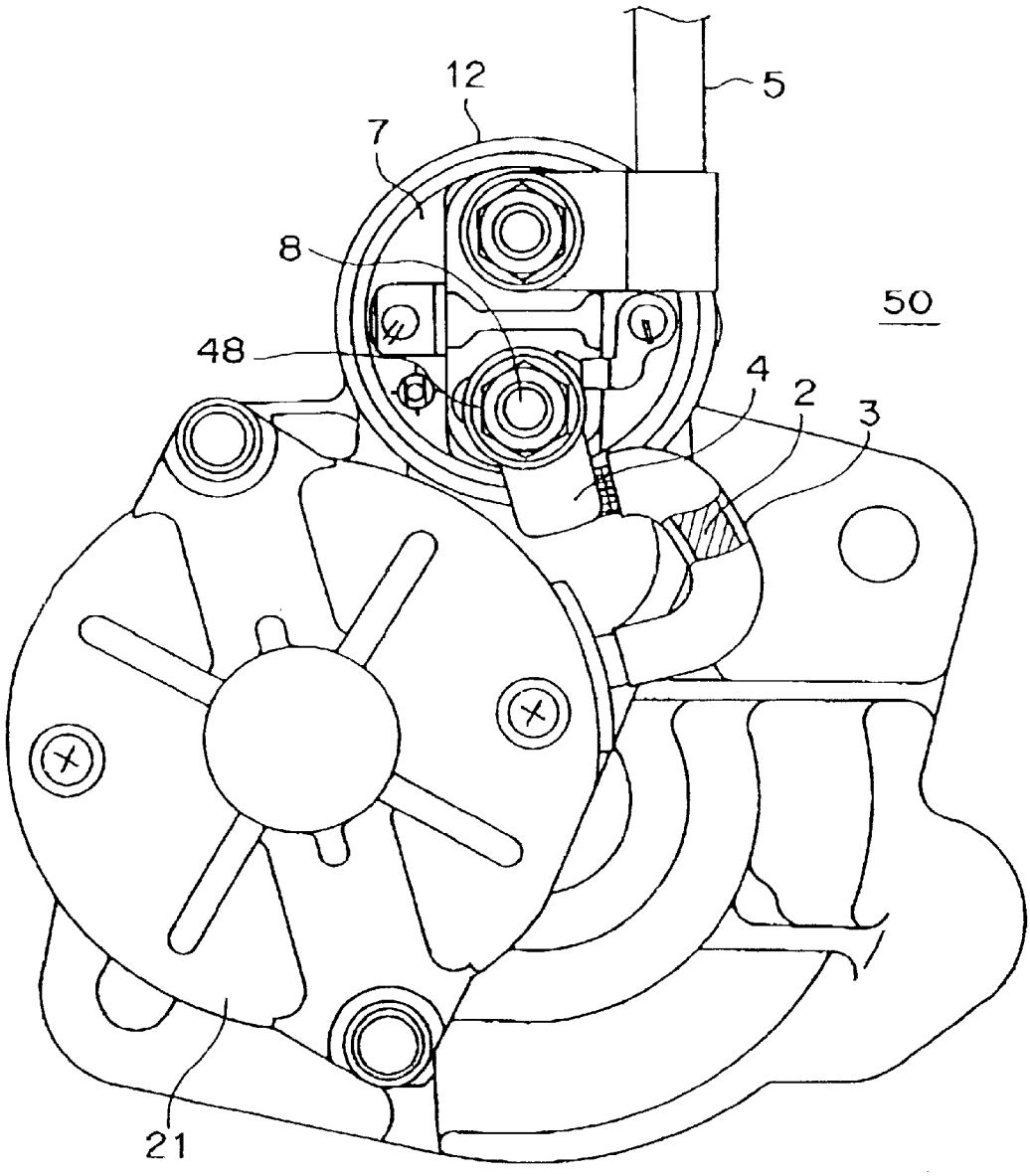
FIG. 3 is an external view of an engine starting device according to one embodiment of the present invention.

If the M lead wire 2 itself shown In FIG. 3 is formed of either copper alloy, soldering material or aluminum, the construction is simple and the similar effect is obtained.

Figure 9:
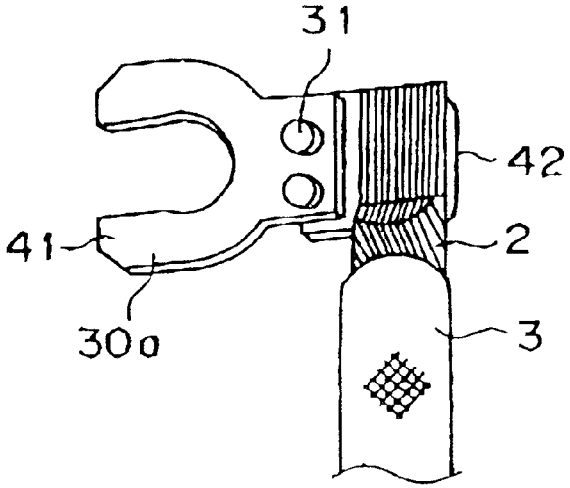
FIG. 9 is a construction view of one embodiment of the present invention.

The terminal 4 for connecting the M lead wire 2 in FIG. 3 to the M terminal 8 of the electromagnetic switch 12 is may be formed of the same material as the aforementioned circuit disconnecting member. This embodiment and the detail of construction are shown in FIGS. 3 and 12, and FIGS. 9 to 11, respectively. The circuit disconnecting member is formed from plate members 30*a*, 30*b* and 30*c* formed of material of either copper alloy, soldering material or aluminum. FIG. 9 shows an embodiment in which the terminal 4 is divided into a terminal 41 and a terminal 42, and the terminal 41 is connected to the terminal 42 as the plate member 30*b* of the circuit disconnecting member. FIG. 10 shows an embodiment in which the terminal 4 is divided into a terminal 43 and a terminal 44, and the plate member 30*b* of the circuit disconnecting member is connected between the terminal 43 and the terminal 44. Further, FIG. 11 shows an embodiment in which the terminal 4 is formed as the plate member 30*c* of the circuit disconnecting member. Where a general brazing technique (typically, a brazing temperature is 705 to 815° C.) is used for a method for connection between the plate member 30*a* and the terminal 42, the plate member 30*b* and the terminals 43, 44, and the plate member 30*c* and the M lead wire 2, the connection temperature thereof is substantially equal to a blowing temperature of the circuit disconnecting member, and where aluminum is selected for a plate member, aluminum and copper which are different metals are connected. Therefore it is difficult or impossible to perform brazing. Because of this, the technique for facilitating the connection method is a method for crimping the plate members 30*a*, 30*b* to the terminals 42, 43, 44 using a rivet 31. In place of the rivet 31. the crimping connection in the shape of hole flanging extruded from terminals 42, 43, 44 may be employed. If connection is made using an ultrasonic wave connection, the rivet 31 can be abolished as shown in FIG. 11. The riveting connection, the hole flanging connection and the ultrasonic connection can be also applied to the connection between the plate member 26 and the terminals 25*a*, 25*b* shown in FIGS. 7 and 8, and the connection between the M lead wire 2 and the terminal 4 shown in FIG. 3.

Figure 4:
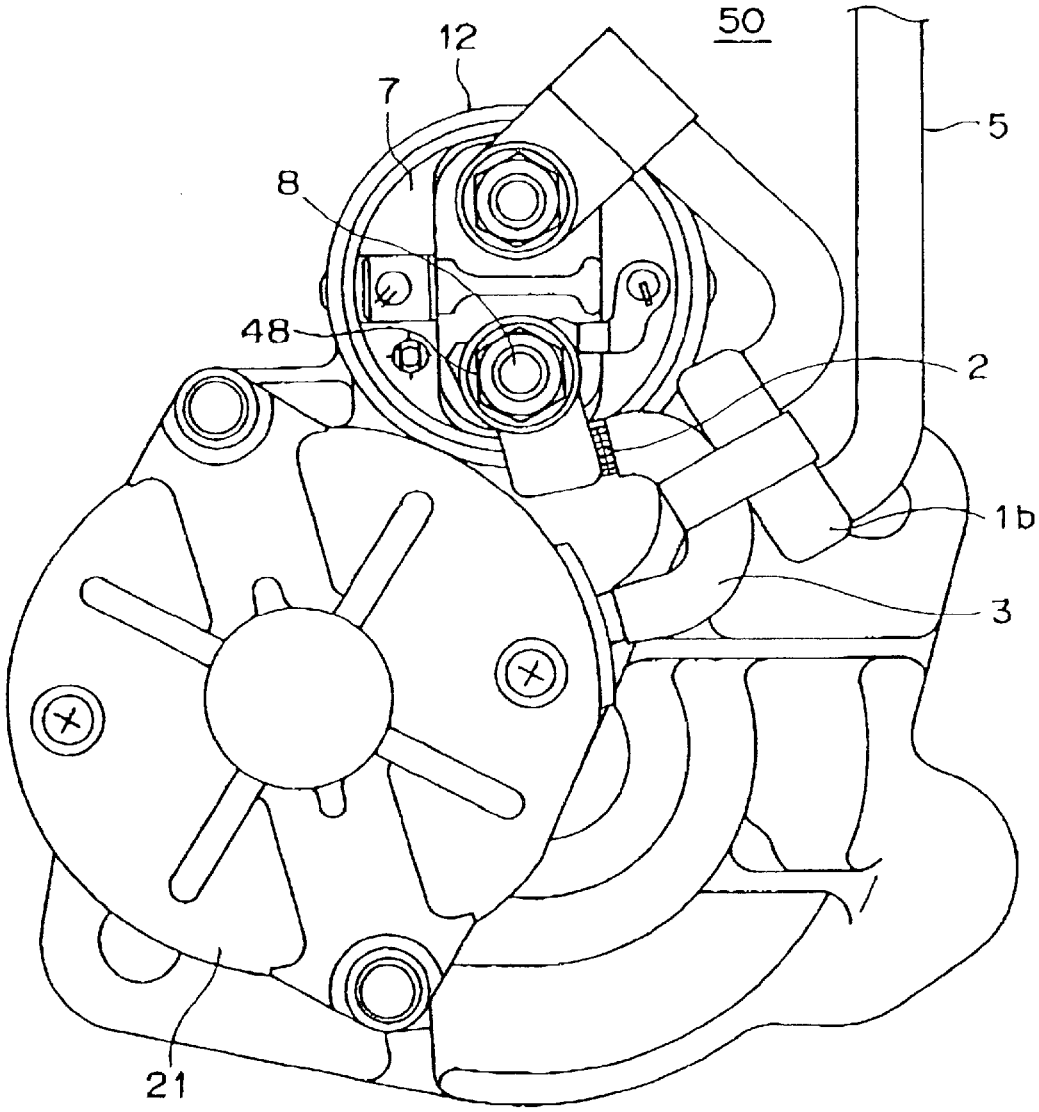
FIG. 4 is an external view of an engine starting device according to one embodiment of the present invention.

In FIG. 4, connected into the battery cable 5 is a circuit disconnector 1*b* that blows on receiving radiant heat generated by heat generation of the circuit of the motor 21 and blows at a temperature lower than a thermal breakdown temperature of combustible substances around the circuit of the motor 21. The disconnector 1*b* is installed on the side of the M lead wire 2 and blows on receiving radiant heat generated by heat generation of the M lead wire 2.

Figure 5:
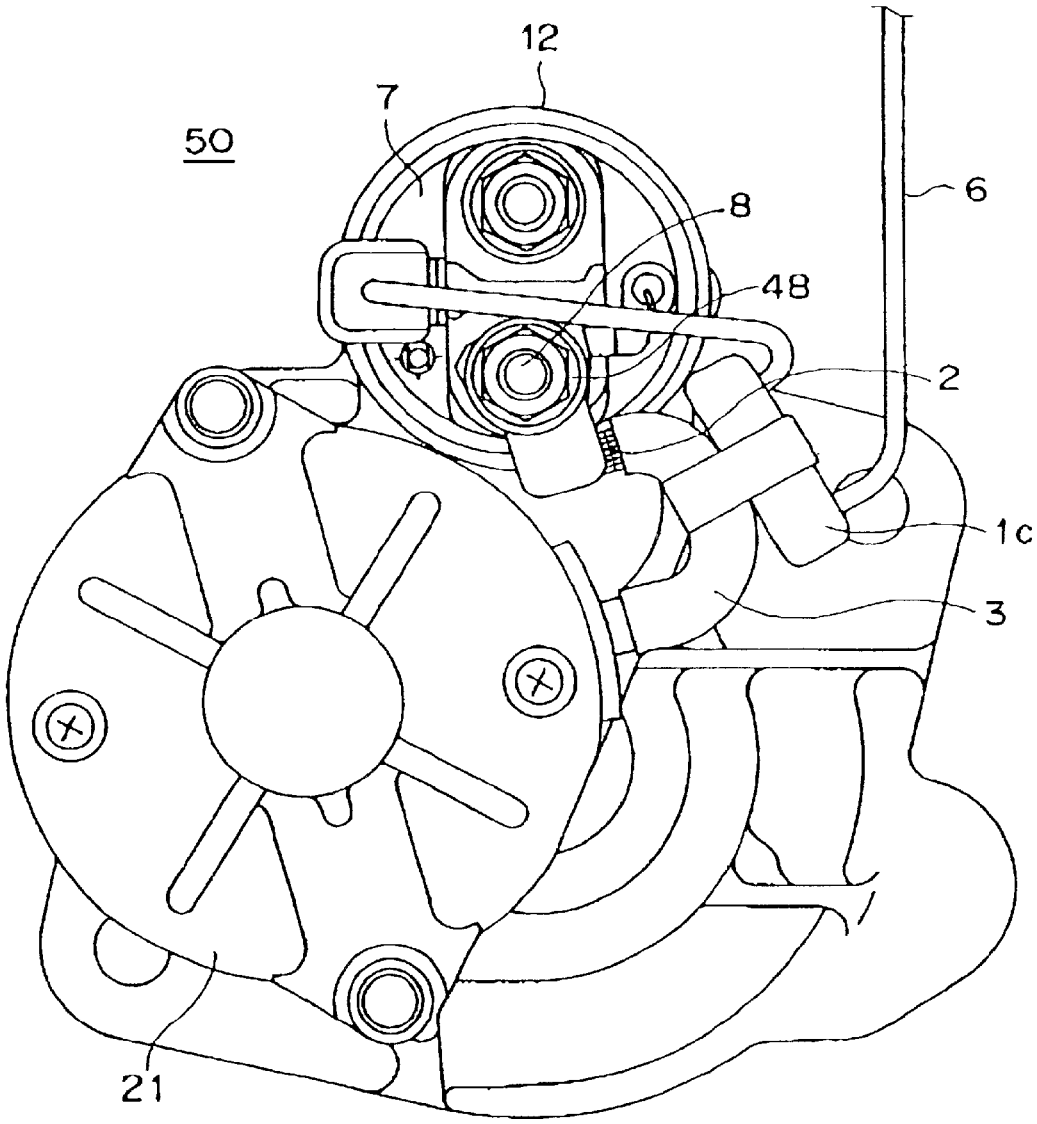
FIG. 5 is an external view of an engine starting device according to one embodiment of the present invention.
Figure 6:
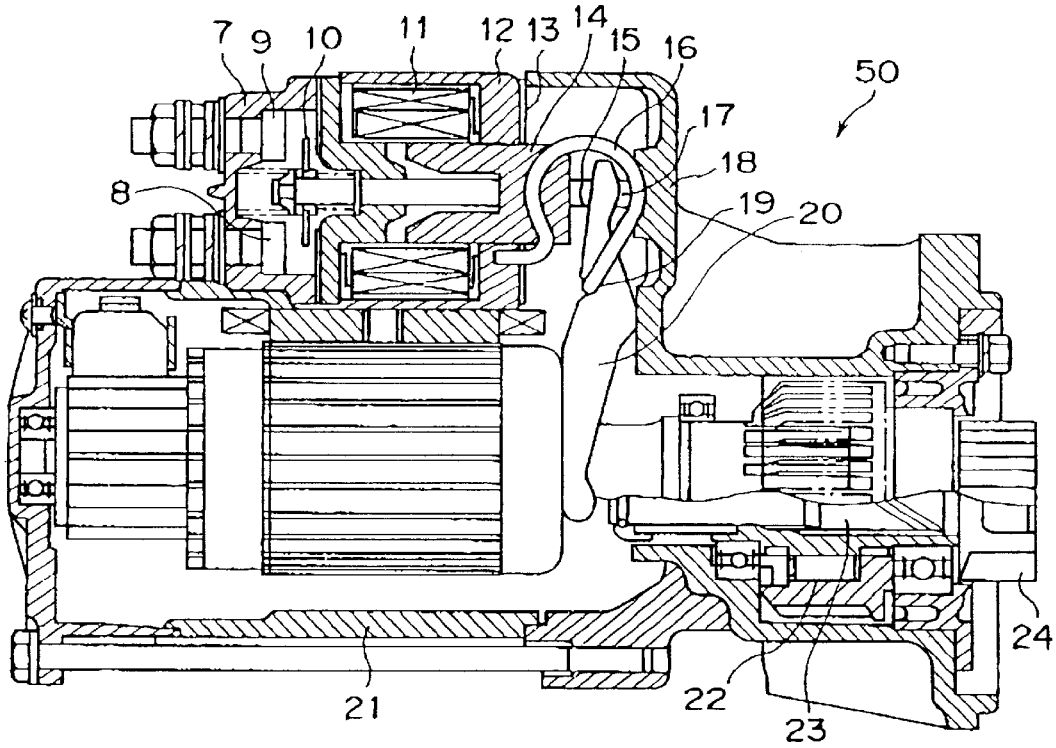
FIG. 6 is the whole construction view of an engine starting device according to one embodiment of the present invention.

In the embodiment shown in FIG. 5, a circuit disconnector 1*c* equivalent to the circuit disconnector 1*b* is connected into a key switch circuit 6 of a stating motor 50. The circuit disconnector 1*c* is installed on the side of the M lead wire 2 so as to receive radiant heat generated by heat generation of the M lead wire 2.

With the above-described construction, when an operator turns on the key, the coil 11 of the electromagnetic switch 12 is energized so that the plunger 14 is attracted to draw the head of the shift lever 20 rearward (leftward in the figure). Since the central part of the shift lever 20 is held by the torsion spring 16, the shift lever 20 makes the action of a lever about that point as a fulcrum to push out the pinion shaft 23 forward (rightward in the figure). The pinion 24 is meshed into the ring gear of the engine by forward movement of the pinion shaft 23. The plunger 14 is further attracted even after the meshing. On the other hand, at that time, the movable contact 10 is pushed out rearward (leftward in the figure) by the plunger 14 so that the movable contact 10 comes into contact with the B terminal 9 and the M terminal 8 to close a contact circuit, whereby a current flows from the battery cable 5 to the motor 21 to rotate the motor 21 and start the engine. When the starting motor 50 receives the continuous energization or the intermittent energization of a cycle for a short time (for example, intermittent energization such as repetition of energization of ON for 30 seconds, and OFF for 30 seconds), self heat generation of an energization part increases, and a part where self heat generation is in excess of radiant heat accumulates heat. In a conventional starting motor 50*a*, particularly heat generation at the M lead wire 2 and the M terminal 8, and the connection part between the M lead wire 2 and the M terminal 8 is great, and when the heat accumulation temperature of that part reaches not less than about 900° C., the insulating cover 3 and the contact case 7 result in a thermal breakdown due to the radiant heat.

The operation of the present embodiment will be described below.

In the starting motor 50 in the above-described embodiment, the circuit disconnector 1*a* is connected to one end of the M lead wire 2 to receive radiant heat caused by heat generation of the M lead part 2 or the connection part 48 between the M terminal 8 and the M lead wire 2, whereby the circuit disconnecting member blows, before reaching the heat accumulation temperature 900° C. at which the insulation cover 3 or the contact case 7 will be subjected to the thermal breakdown, to shut off the circuit of the motor 21 quickly to stop heat generation.

The M lead wire 2 is used as the circuit disconnecting member whereby the M lead wire 2 itself blows, before reaching the heat accumulation temperature 900° C. at which the insulation cover 3 or the contact case 7 will be subjected to the thermal breakdown, to shut off the circuit of the motor 21 to impede heat generation.

Further, the terminal 4 for connecting the M lead wire 2 and the terminal 4 are used as the circuit disconnecting member whereby the terminal 4 itself blows, before reaching the heat accumulation temperature 900° C. at which the insulation cover 3 or the contact case 7 will be subjected to the thermal breakdown, to shut off the circuit of the motor 21 to impede heat generation.

Further, the circuit disconnector 1*b* is connected into the battery cable 5 and the circuit disconnector 1*b* is installed on the side of the M lead wire 2 whereby the disconnecting member blows, before reaching the heat accumulation temperature 900° C. at which the insulation cover 3 or the contact case 7 will be subjected to the thermal breakdown, to shut off the battery cable 5 to impede heat generation.

Further, the circuit disconnector 1*c* is connected into the key switch circuit 6 of the starting motor 50 and the circuit disconnector 1*c* is installed on the side of the M lead wire 2 whereby the disconnecting member blows, before reaching the heat accumulation temperature 900° C. at which the insulation cover 3 or the contact case 7 will be subjected to the thermal breakdown, to shut off the key switch circuit 6 to stop the starting motor 50 to stop heat generation.

As described above, according to the starting motor 50 in the present embodiment, the circuit disconnector 1*a* is connected to one end of the M lead wire 2 to thereby prevent the insulation cover 3 and the contact case 7 from being subjected to the thermal breakdown due to the radiant heat.

Further, the M lead wire 2 is used as the circuit disconnecting member to thereby prevent the insulation cover 3 and the contact case 7 from being subjected to the thermal breakdown due to the radiant heat.

Further, the terminal 4 for connecting the M lead wire 2 and the M terminal are used as the circuit disconnecting member to thereby prevent the insulation cover 3 and the contact case 7 from being subjected to the thermal breakdown due to the radiant heat.

Further, the circuit disconnector 1*b* is connected into the battery cable 5 and installed on the side of the M lead wire 2 to thereby prevent the insulation cover 3 and the contact case 7 from being subjected to the thermal breakdown due to the radiant heat.

Furthermore, the circuit disconnector 1*c* is connected into the key switch circuit 6 of the starting motor 50 and installed on the side of the M lead wire 2 to thereby prevent the insulation cover 3 and the contact case 7 from being subjected to the thermal breakdown due to the radiant heat.

INDUSTRIAL APPLICABILITY

According to the present invention, there can be provided a starting motor capable of preventing the starting motor from resulting in a thermal breakdown by a small-size and simple construction and an inexpensive technique to prevent heat generation parts and combustible substances in the vicinity thereof from being subjected to thermal breakdown, without impairing the mounting layout properties of the starting motor and the performance within the rated use, wherein a "circuit disconnecting member that blows on receiving radiant heat generated by heat generation generated by heat generation of a circuit of the motor and blows at a temperature lower than a thermal breakdown temperature of a combustible substance around the circuit of the motor" is connected into the motor circuit, the battery cable or the key switch circuit, and radiant heat caused by heat generation of the M lead wire or a connection part between the M terminal and the M lead wire is received.

What is claimed is:

1. Starting motor apparatus comprising:

a pinion for transmitting rotation of said motor to an engine shaft; and a motor circuit for driving said motor;

wherein said motor circuit includes a circuit disconnecting member that disconnects said motor circuit in response to absorption of radiant heat generated by said motor circuit, at a temperature lower than a thermal breakdown temperature of a combustible substance around said motor circuit.

2. Starting motor apparatus comprising:

a motor;

a pinion for transmitting rotation of said motor to an engine shaft;

a motor circuit for driving said motor; and a circuit disconnecting member that disconnects said motor circuit in response to absorption of radiant heat generated by said motor circuit;

wherein said circuit disconnecting member is connected to said motor circuit and disconnects said motor circuit at a temperature lower than a thermal breakdown temperature of a combustible material around said motor circuit.

3. The starting motor apparatus according to claim 1, wherein said circuit disconnecting member is installed in a battery cable receiving radiant heat generated by heat generation of the motor circuit.

4. The starting motor apparatus according to claim 1, wherein said circuit disconnecting member is installed in a key switch circuit receiving radiant heat generated by heat generation of the motor circuit.

5. Starting motor apparatus comprising:

a motor;

a pinion for transmitting rotation of said motor to an engine shaft;

a motor circuit for driving said motor; and an electromagnetic switch having a contact for opening and closing energization to said motor;

wherein a member for connecting a terminal of said contact to said motor circuit includes a circuit disconnecting member that disconnects said motor circuit in response to absorption of radiant heat generated by said motor circuit, at a temperature lower than a thermal breakdown temperature of a combustible substance around said motor circuit.

6. Starting motor apparatus comprising:

a motor rotated by energization from a battery;

a pinion to which rotation of said motor is transmitted;

a shift lever for moving said pinion toward a ring gear of an engine;

an electromagnetic switch having a coil for inducing an electromagnetic force;

an axially slidable plunge and a contact for opening said closing energization to said motor; and a circuit disconnecting member which is connected into the motor circuit, and disconnects said motor circuit in response to absorption of radiant heat generated by said motor circuit, at a temperature lower than a thermal breakdown temperature of a combustible substance around said motor circuit.

7. The starting motor according to claim 5, wherein a member for connecting a terminal of said contact to the motor circuit is connected to a part of said motor circuit, by riveting or hole flanging.

8. The starting motor according to claim 5, wherein a member for connecting a terminal of said contact to the motor circuit is connected to a part of said motor circuit using an ultrasonic wave connecting method.

9. A protective device for preventing thermal breakdown of an electric motor, comprising:

a motor circuit for supplying electric current to drive said motor; and a circuit disconnecting member included in said motor circuit for interrupting the supply of electric current to the motor; wherein the circuit disconnecting member is made of a material that melts in response to absorption of radiant heat impinging on a surface thereof; and said circuit disconnecting member is mounted externally adjacent said motor, whereby radiant heat generated by said motor is absorbed by said circuit disconnecting member.

* * * * *